US007163031B2

(12) United States Patent
Graves et al.

(10) Patent No.: US 7,163,031 B2
(45) Date of Patent: Jan. 16, 2007

(54) AUTOMATED DISPENSING SYSTEM AND ASSOCIATED METHOD OF USE

(75) Inventors: Kevin Graves, Catawissa, MO (US); Andrew Williams, Lake St. Louis, MO (US); Andrew M. Schadt, Edwardsville, IL (US); David M. Wong, Chesterfield, MO (US)

(73) Assignee: Mallinckrodt Inc., St. Louis, MO (US)

( * ) Notice: Subject to any disclaimer, the term of this patent is extended or adjusted under 35 U.S.C. 154(b) by 326 days.

(21) Appl. No.: 10/867,918

(22) Filed: Jun. 15, 2004

(65) Prior Publication Data

US 2005/0278066 A1 Dec. 15, 2005

(51) Int. Cl.
*B65B 1/04* (2006.01)

(52) U.S. Cl. ..... 141/9; 141/104; 141/27; 141/302; 604/407; 604/416; 250/430

(58) Field of Classification Search ..... 141/2, 141/18, 9, 100, 104, 21–27, 301, 302; 604/407, 604/416; 250/428, 430, 522.1, 506.1, 507.1
See application file for complete search history.

(56) References Cited

U.S. PATENT DOCUMENTS

| | | | | |
|---|---|---|---|---|
| 3,935,883 A | | 2/1976 | Stach et al. | |
| 4,296,785 A | * | 10/1981 | Vitello et al. | 141/105 |
| 5,039,863 A | * | 8/1991 | Matsuno et al. | 250/432 PD |
| 5,329,976 A | * | 7/1994 | Haber et al. | 141/25 |
| 5,479,969 A | | 1/1996 | Hardie et al. | |
| 5,831,271 A | * | 11/1998 | Okano et al. | 250/432 PD |
| 5,911,252 A | | 6/1999 | Cassel | |
| 7,017,623 B1 | * | 3/2006 | Tribble et al. | 141/27 |
| 2001/0009994 A1 | | 7/2001 | Small et al. | |
| 2004/0154690 A1 | | 8/2004 | Osborne et al. | |

FOREIGN PATENT DOCUMENTS

| | | |
|---|---|---|
| EP | 1048325 A2 | 11/2000 |
| EP | 1236644 | 9/2004 |
| FR | 2739565 | 4/1997 |
| GB | 1415804 | 11/1975 |
| JP | 401129199 A | 5/1989 |
| JP | 401244759 A | 9/1989 |
| JP | 401245185 A | 9/1989 |
| JP | 402090091 A | 3/1990 |
| JP | 403039699 A | 2/1991 |
| WO | WO 2004/004802 | 1/2004 |
| WO | WO 2004/108533 | 10/2004 |
| WO | WO 2005002971 | 1/2005 |

* cited by examiner

*Primary Examiner*—Steven O. Douglas

(57) ABSTRACT

An automated bulk dispensing system and a method of use including selectively receiving a predetermined amount of radioactive liquid from a second container into a third container, selectively receiving a predetermined amount of nonradioactive liquid from a first container into a fourth container or directly into the third container depending on whether kits or multi-dose containers of medicine are desired. Preferably, this is for nuclear pharmaceuticals. Displacement mechanisms that are connected to the third container and fourth container are for mixing and dispensing liquid. There is at least one control valve, preferably three control valves, which are each controlled by drive mechanisms. The mixed liquid from the third container can be transferred to a recipient container. There is also a gas vent and bubble detector to eliminate bubbles with a processor that is also utilized to control the displacement mechanisms and the drive mechanisms.

28 Claims, 5 Drawing Sheets

AUTOMATED DISPENSING SYSTEM AND ASSOCIATED METHOD OF USE

BACKGROUND OF THE INVENTION

Most of the current nuclear medicine diagnostic procedures use a radioisotope. An illustrative, but nonlimiting, example of a radioisotope includes technetium (Tc-99m). The radioactive technetium, obtained from a generator located in a radio-pharmacy, is dissolved in a saline solution and is placed in an eluate vial which is surrounded by a lead eluate shield or pig. The activity level of this technetium is high (approximately 100 to 1,000 mCi/mL at time of preparation) and is often diluted before it is used. The radiopharmacy can prepare multi-dose vials of technetium and saline and/or ready-to-use kits that include: (a) technetium; (b) saline; and (c) lyophilized reagents. The multi-dose vials of technetium are also sold to hospitals and other medical facilities. The hospitals may use the technetium from the multi-dose vial to administer to a patient or to prepare their own lyophilized reagent kits. The multi-dose vials have an activity level that varies from 10–200 mCi/mL at time of preparation.

The ready-to-use kits include lyophilized reagents, which do not contain radioactive material, are the product of the "cold" production line. The lyophilized reagents have been formulated to collect at specific locations in the body such as the heart, bones or kidneys. The radioactive kits are prepared by mixing technetium and saline with the lyophilized reagents at the radiopharmacies. Most of these "prepared" kits contain several individual doses and have an activity level that varies widely depending on the type of radiopharmaceutical prescribed. The activity level in a "prepared kit" may range from 10 to 200 mCi/mL at the time of preparation.

Currently kits and multi-dose vials of radioisotopes, e.g., technetium, are filled by hand by a pharmacist and/or their technician at the radiopharmacy. This will lead to extremity exposure for the personnel during handling the radioactive materials (e.g., transferring liquid from one vial to another with the use of a syringe in a syringe shield). These pharmacists and technicians are required to wear extremity dosimeters and must comply with annual radiation exposure limits. If their cumulative radiation exposure limit nears their annual limit, the pharmacist or technician is restricted from the lab and must work elsewhere in the radiopharmacy. This will increase the manpower demands at the radiopharmacy and could potentially increase the level of radiation exposure for remaining pharmacists and technicians.

SUMMARY OF INVENTION

In one aspect of this invention, an automated bulk dispensing system is disclosed. This includes a first container, a second container, a third container, a first displacement mechanism that is operatively connected to the third container for displacing liquid from the third container, a recipient container, at least one first control valve, wherein the first container is connected in fluid relationship to the at least one first control valve and the second container is connected in fluid relationship to the at least one first control valve and the third container is connected in fluid relationship to the at least one first control valve, at least one first drive mechanism that is operatively attached, in one-to-one correspondence, to the at least one first control valve, wherein the at least one first drive mechanism by operation of the at least one first control valve can selectively control a flow of liquid from the first container into the third container, wherein the at least one first drive mechanism by operation of the at least one first control valve can selectively control a flow of liquid from the second container into the third container and wherein the at least one first drive mechanism by operation of the at least one first control valve can selectively control a flow of liquid from the third container into the recipient container, and a processor that is electrically connected to the at least one first drive mechanism and the first displacement mechanism for selective activation thereof.

In another aspect of this invention, a method for filling containers utilizing an automated bulk dispensing system is disclosed. This includes selectively receiving a predetermined amount of radioactive liquid from a second container into a third container through at least one first control valve, selectively receiving a predetermined amount of nonradioactive liquid from a first container into a third container that is operatively connected to the third container through at least one first control valve, mixing the radioactive liquid and the nonradioactive liquid in the third container with a first displacement mechanism, which is operatively connected to the third container for displacing liquid within the third container, wherein the first displacement mechanism is selectively controlled by a processor and is operatively connected thereto, and dispensing the mixture of the radioactive liquid and the nonradioactive liquid from the third container with the first displacement mechanism through the at least one first control valve and into a recipient container, wherein the first container is connected in fluid relationship to the at least one first control valve, the second container is connected in fluid relationship to the at least one first control valve and the third container is connected in fluid relationship to the at least one first control valve and there is at least one first drive mechanism that is operatively attached, in one-to-one correspondence, to the at least first control valve to selectively control the flow of liquid into and out of the third container, wherein the first drive mechanism is controlled by the processor and is operatively connected thereto.

In yet another aspect of this invention, an automated bulk dispensing system is disclosed. This includes a first container, a first control valve connected in fluid relationship to the first container, a second container, a second control valve connected in fluid relationship to the second container, a third container connected in fluid relationship to the second control valve, a first displacement mechanism that is operatively connected to the third container for dispensing fluid from the third container, a fourth container connected in fluid relationship to the first control valve, a second displacement mechanism that is operatively connected to the fourth container for dispensing fluid from the fourth container, a third control valve that is connected in fluid relationship between the first control valve and the second control valve, a first drive mechanism operatively attached to the first control valve for selectively controlling liquid flow from the first control valve, a second drive mechanism operatively attached to the second control valve for selectively controlling liquid flow from the second control valve, a third drive mechanism operatively attached to the third control valve for selectively controlling fluid flow from the first control valve, a recipient container that is connected in fluid relationship to the third control valve, and a processor that is operatively connected to the first displacement mechanism, the second displacement mechanism, the first drive mechanism, the second drive mechanism and the third drive mechanism.

In still another aspect of this invention, a method for filling containers utilizing an automated bulk dispensing system is disclosed. The method includes selectively receiving a predetermined amount of radioactive liquid from a second container into a third container through a second control valve, selectively receiving a predetermined amount of nonradioactive liquid from a first container into a fourth container through a first control valve, selectively transferring a predetermined amount of nonradioactive liquid from the fourth container into the third container through a third control valve and the second control valve with a first displacement mechanism, which is operatively connected to the fourth container for displacing liquid from the fourth container and the first displacement mechanism is selectively controlled by a processor and is operatively connected thereto, and mixing the radioactive liquid and the nonradioactive liquid in the third container with a second displacement mechanism, which is operatively connected to the third container for displacing liquid from the third container, wherein the second displacement mechanism is selectively controlled by a processor and is operatively connected thereto, and dispensing the mixture of the radioactive liquid and the nonradioactive liquid from the third container with the second displacement mechanism through the second control valve and the third control valve into a recipient container, wherein the first container and the fourth container are connected in fluid relationship to the first control valve, the second container and the third container are connected in fluid relationship to the second control valve, the first control valve and the second control valve are connected in fluid relationship to the third control valve and the recipient container is connected in fluid relationship to the third control valve, wherein there is a first drive mechanism that is operatively attached to the first control valve, a second drive mechanism that is operatively attached to the second control valve and a third second drive mechanism that is operatively attached to the third control valve, wherein the first drive mechanism, the second drive mechanism, and the third drive mechanism are all selectively controlled by the processor and are operatively connected thereto.

In yet another aspect of the present invention, a method for filling containers utilizing an automated bulk dispensing system is disclosed. This method includes selectively receiving a predetermined amount of radioactive liquid from a second container into a third container through a second control valve, selectively receiving a predetermined amount of nonradioactive liquid from a first container into a third container that is operatively connected to the third container through a first control valve, a third control valve and the second control valve, mixing the radioactive liquid and the nonradioactive liquid in the third container with a first displacement mechanism, which is operatively connected to the third container for displacing liquid within the third container, wherein the first displacement mechanism is selectively controlled by a processor and is operatively connected thereto, and dispensing the mixture of the radioactive liquid and the nonradioactive liquid from the third container with the first displacement mechanism through the second control valve and the third control valve and into a recipient container, wherein the first container is connected in fluid relationship to the first control valve, the second container is connected in fluid relationship to the second valve and the third container is connected in fluid relationship to the third control valve, the first control valve and the second control valve are connected in fluid relationship to the third control valve, wherein there is a first drive mechanism that is operatively attached to the first control valve, a second drive mechanism that is operatively attached to the second control valve and a third drive mechanism that is operatively attached to the third control valve, wherein the first drive mechanism, the second drive mechanism, and the third drive mechanism are all selectively controlled by the processor and are operatively connected thereto.

These are merely some of the innumerable aspects of the present invention and should not be deemed an all-inclusive listing of the innumerable aspects associated with the present invention. These and other aspects will become apparent to those skilled in the art in light of the following disclosure and accompanying drawings.

BRIEF DESCRIPTION OF DRAWINGS

For a better understanding of the present invention, reference may be made to the accompanying drawings in which.

DETAILED DESCRIPTION OF THE INVENTION

In the following detailed description, numerous specific details are set forth in order to provide a thorough understanding of the invention. However, it will be understood by those skilled in the art that the present invention may be practiced without these specific details. In other instances, well-known methods, procedures and components have not been described in detail so as to obscure the present invention.

Figure 1:
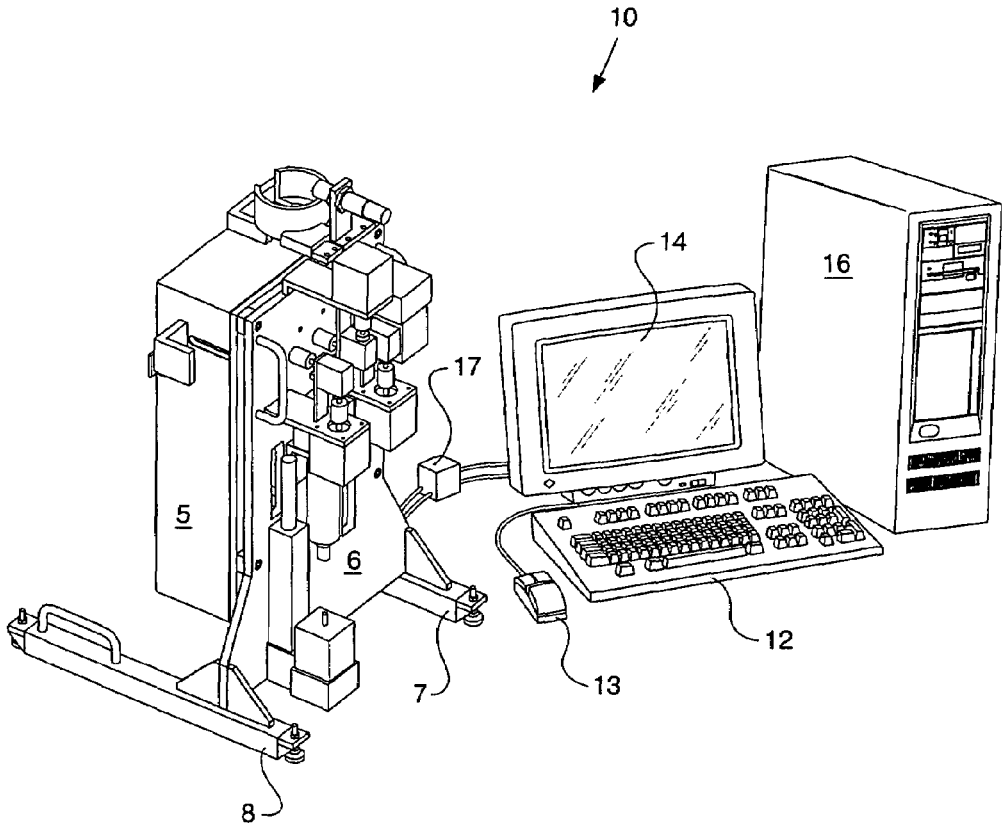
FIG. 1 is a perspective view of a dispensing apparatus, processor, electronic display, keyboard and mouse, in accordance with the present invention.

Referring now to the drawings, and initially to FIG. 1, the automated dispensing system is generally indicated by numeral 10. This includes a processor 16 that is generally indicated by numeral 16. A processor referred to herein can be a single processor or a whole series of processors and any variant of a processor such as a computer or a programmable logic controller. There is an electronic display 14. The electronic display 14 is preferably a liquid crystal diode display (SGVA). However, a cathode ray tube, plasma screen and other types of electronic displays 14 will suffice. There is at least one input device that, preferably but not necessarily, includes a touch screen on the electronic display 14 and/or a mouse 13 and/or a keyboard 12. The mouse 13 and keyboard 12 are electrically connected to the processor 16. Preferably, there is an electronic control box 17 that provides power to the electrical components associated with the automated dispensing system 10.

Figure 3:
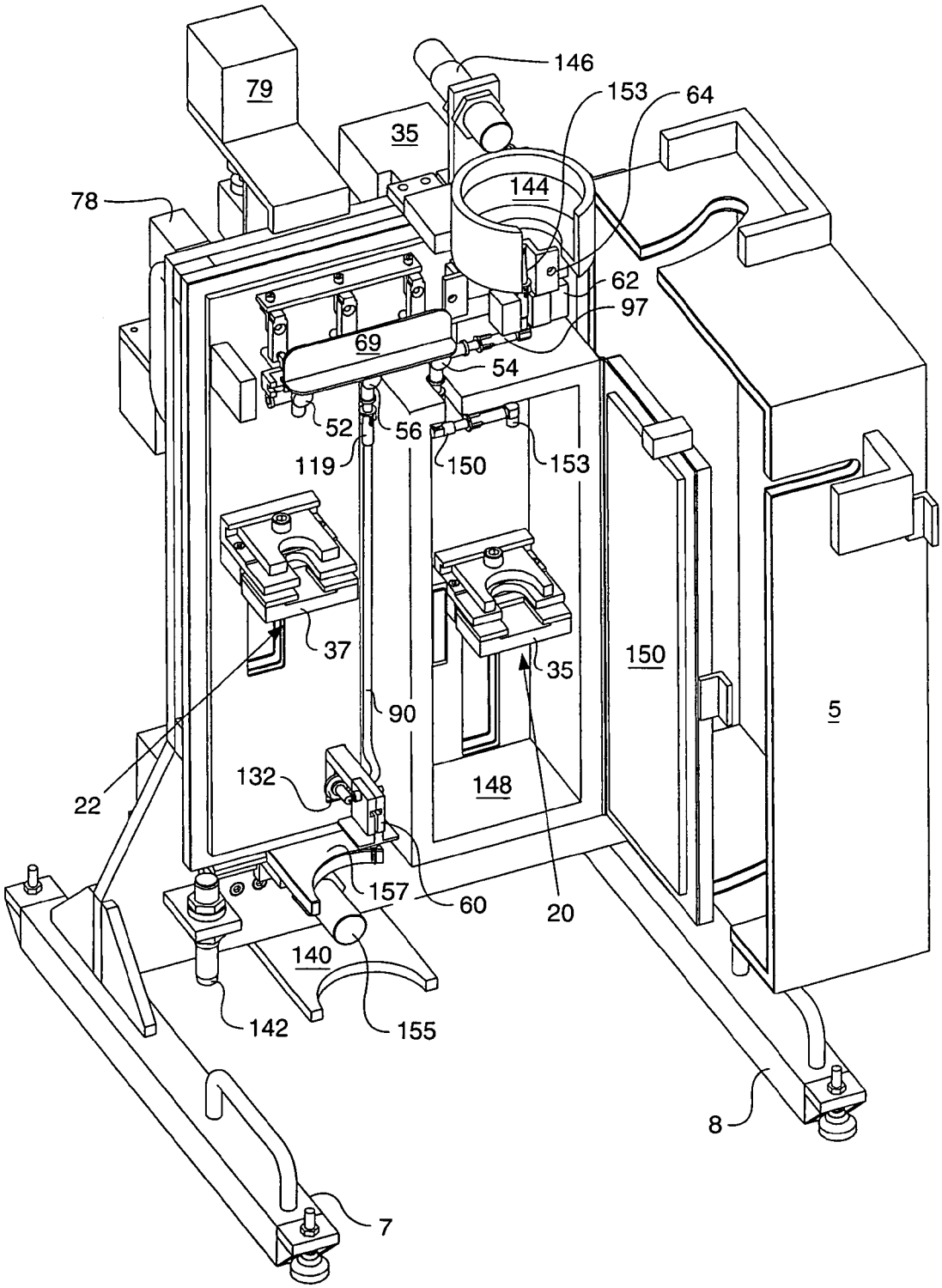
FIG. 3 is an enlarged, front, perspective view of the dispensing apparatus in accordance with the present invention without a first container, a second container, and a recipient container and with the hinged cover enclosure swung open.
Figure 4:
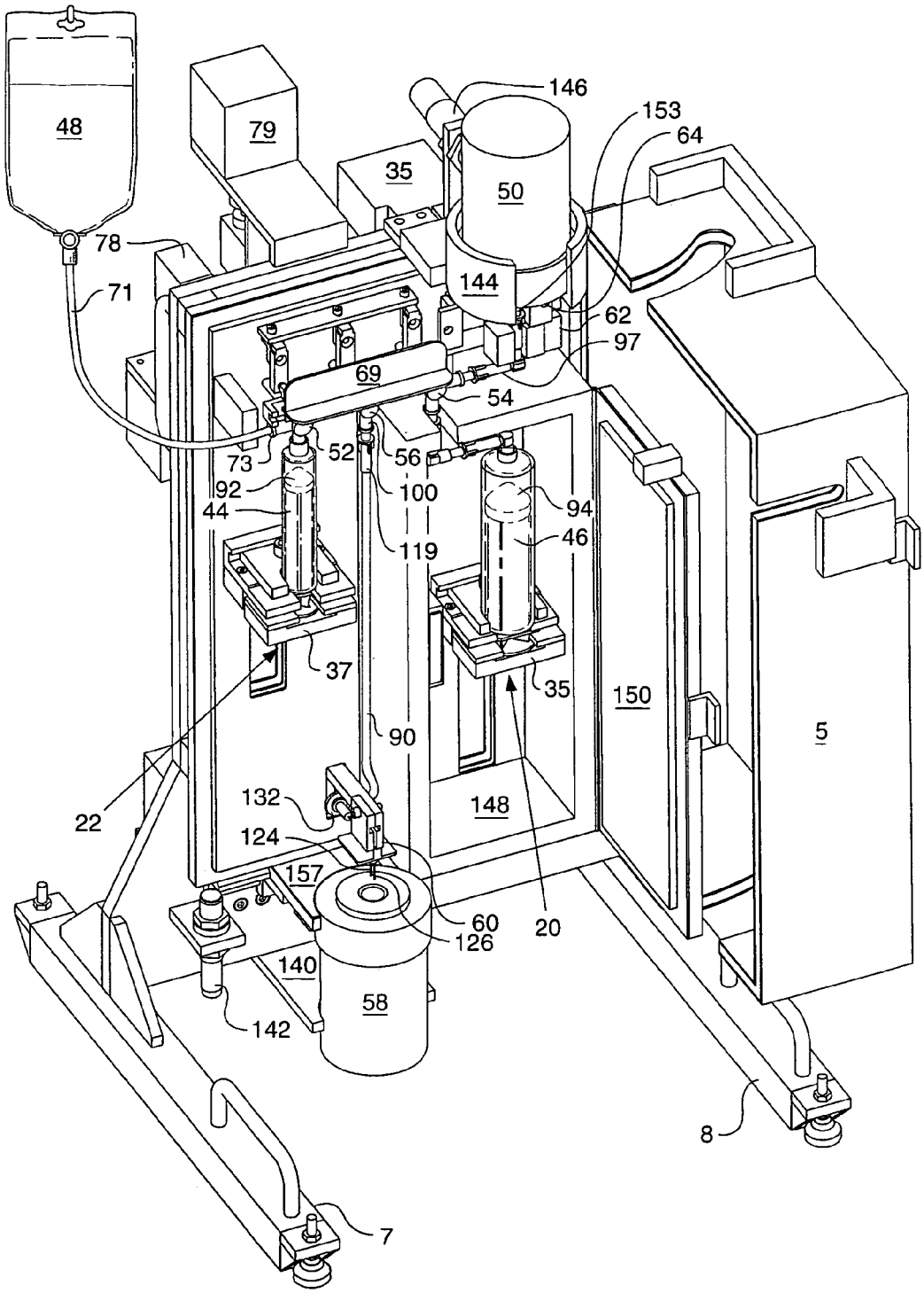
FIG. 4 is an enlarged, side, perspective view of the dispensing apparatus, as shown in FIG. 3, including the first container, the second container, and the recipient container in accordance with the present invention.

Also, in FIG. 1, the automated bulk dispensing system 10 includes a support member 6 that is mounted on a first support leg 7 and a second support leg 8. Preferably, the first support leg 7 and second support leg 8 are adjustable to provide leveling for the support member 6. There is a cover enclosure 5 that is hingedly attached to the support member 6. The cover enclosure 5 is preferably a radiation shield that is optimally made of lead, tungsten or similar material that blocks radiation. The closing of the cover enclosure can be sensed by a third proximity sensor 142 and this information is provided back to the processor 16, as shown in FIGS. 3 and 4. The components that comprise the automated bulk dispensing system 10 can be made of virtually any type of material including, but not limited to, all types of metals and plastics. The fluid path is preferably constructed of pre-sterilized, disposable components.

Referring now to FIGS. 3 and 4, there is a first displacement mechanism 20 and a second displacement mechanism 22 for displacing fluid to and from a third container 46 and to and from a fourth container 44, respectively.

Figure 2:
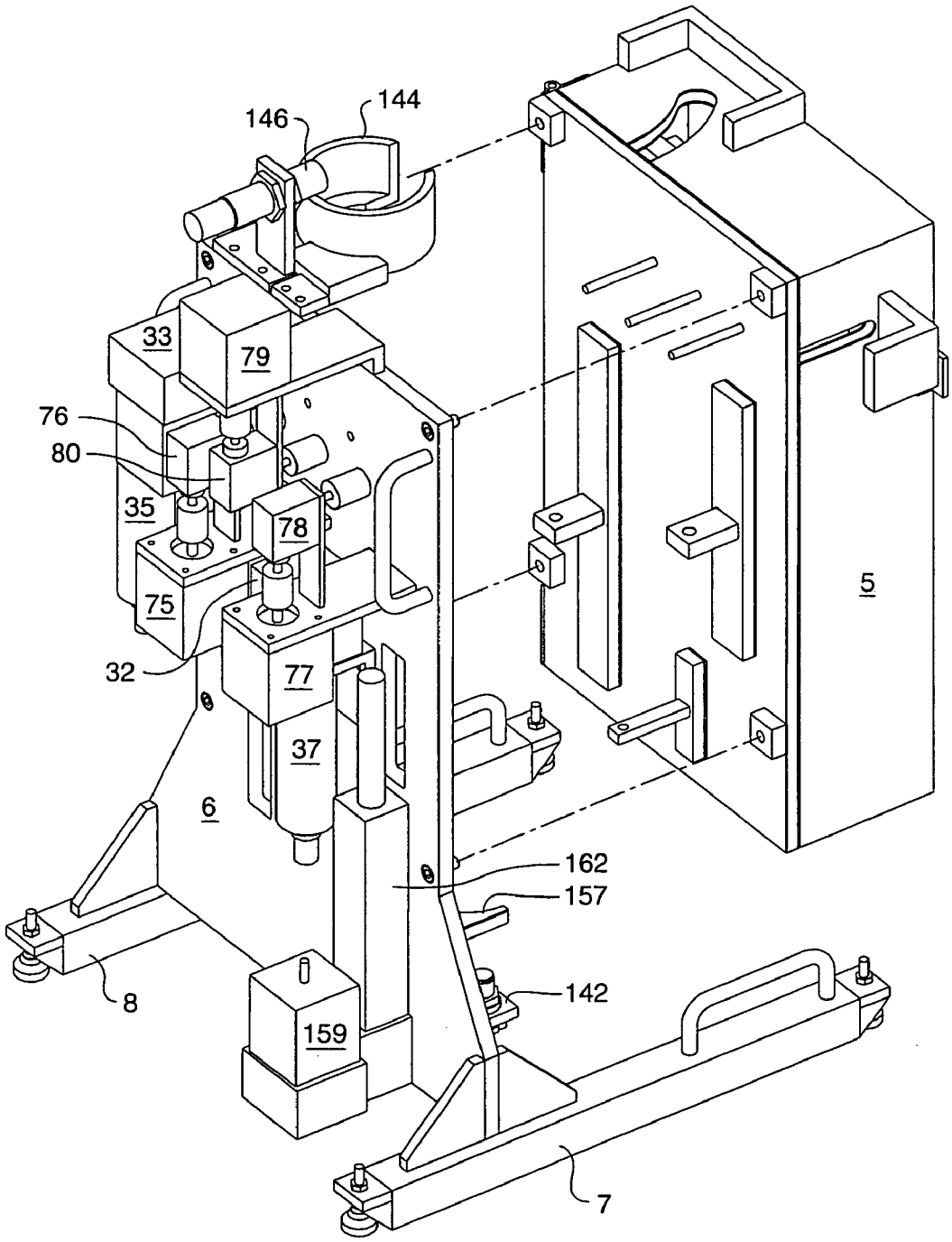
FIG. 2 is an exploded and enlarged rear, perspective view of the dispensing apparatus, as shown in FIG. 1, in accordance with the present invention with the cover enclosure displaced therefrom.

Referring now to FIGS. 2, 3 and 4, the first displacement mechanism 20 is preferably, but not necessarily, a syringe driven sampler. This includes a first motor 33, which is preferably a stepper motor, however, any motor that controls and monitors the position of the rotor and can move the rotor of the motor in controlled increments will suffice such as a servo-controlled motor or actuator controlled motor. The first motor 33 is attached to a first mechanism, e.g., actuator, 35. This first mechanism, e.g., actuator, 35 is preferably, but not necessarily, a lead screw that is driven by the first controlled motor 33. Optimally, there are limits, encoders and other mechanisms to govern the limit of travel for the first mechanism, e.g., actuator, 35 and provide a fixed rotational starting point for the first motor 33. As shown in FIGS. 2, 3 and 4, the first mechanism, e.g., actuator, 35 is connected to a first actuator member 30.

As shown in FIG. 4, the first mechanism, e.g., actuator, 35 through the first actuator member 30 preferably displaces a first plunger 94 within a third container 46. The third container 46 is preferably a syringe, e.g., 35 mL, however, a wide variety of containers and displacement mechanisms will suffice. Preferably, but not necessarily, the third container 46 is enclosed in a separate enclosure 148 with a hinged cover 150 for additional radioactive shielding.

Referring now to FIGS. 2, 3 and 4, the second displacement mechanism 22 is preferably, but not necessarily, a syringe driven sampler. This includes a second motor 159, which is preferably a stepper motor, however, any motor that controls and monitors the position of the rotor and can move the rotor of the motor in controlled increments will suffice such as a servo-controlled motor or actuator controlled motor. Moreover, although less preferred, a wide variety of pneumatic and hydraulic systems can be utilized as displacement mechanisms. The second motor 159 is attached to a second mechanism, e.g., actuator, 162. This second mechanism, e.g., actuator, 162 is preferably, but not necessarily, a lead screw that is driven by the second motor 159. Optimally, there are limits, encoders and other mechanisms to govern the limit of travel for the second mechanism, e.g., actuator, 162 and provide a fixed rotational starting point for the second controlled motor 159. As shown in FIGS. 2, 3 and 4, the second mechanism, e.g., actuator, 162 is connected to a second actuator member 29.

As shown in FIG. 4, the second mechanism, e.g., actuator, 37 through the second actuator member 29 preferably displaces a second plunger 92 within a fourth container 44. The fourth container 44 is preferably a syringe, e.g., 10 mL, however, a wide variety of containers and displacement mechanisms will suffice.

A nonlimiting, but illustrative, example of a first motor 33 and a second motor 32 include HT17-075-200I manufactured by Applied Motion Products, Inc. having a place of business at 404 Westridge Drive, Watsonville, Calif. 95076.

Referring now to FIGS. 3 and 4, a first container for holding fluid is generally indicated by numeral 48. A wide variety of containers will suffice for the first container 48 with the preferred embodiment being a bag for holding fluid. A wide variety of fluids may be utilized in this first container 48 with the preferred fluid being a saline solution.

There is a first fluid conduit 71 that is connected between the first container 48 and a first fluid inlet 73 for a manifold 69 that connects a first control valve 52, a second control valve 54 and a third control valve 56, which are all selectively in fluid relationship. The manifold 69 operates as a fluid conduit that allows fluid to pass between the control valves 52, 54, and 56, when one or more of the control valves 52, 54, and 56 are open. The fluid inlet 73 and the fourth container 44 are both connected to the first control valve 52. The first control valve 52 is also connected via the manifold 69 to the third control valve 56.

Figure 5:
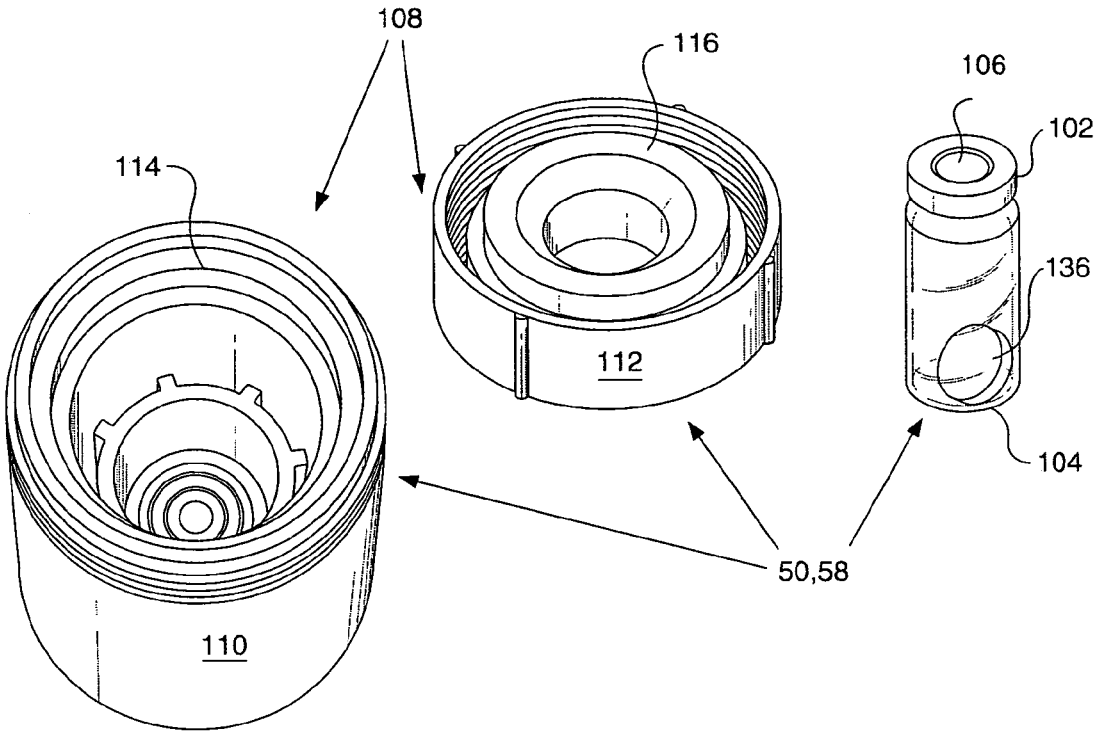
FIG. 5 is an enlarged, perspective view of the eluate shield or pig and/or recipient shield or pig that has been disassembled and an second container, e.g., eluate vial, or recipient container, e.g., recipient vial, in accordance with the present invention.

Also, as shown in FIG. 4, a second container for holding fluid is generally indicated by numeral 50. Preferably, but not necessarily, the second container 50 is held in place by a first c-shaped holder 144 and the presence of the second container 50 is sensed by a first proximity sensor 146. A wide variety of containers will suffice for the second container 50 with the preferred embodiment being an eluate vial 104, as shown in FIG. 5. The eluate vial 104 includes a cap 102 and a septum 106. The septum 106 is preferably pierced by a needle and made of an elastomeric material, e.g., rubber. The second container 50 is preferably enclosed by a radiopharmaceutical pig 108 that includes a top portion 112 and a bottom portion 110. The top portion 112 preferably, but not necessarily, includes a first shielding material 116 for radiation and the bottom portion 110 preferably, but not necessarily, includes a second shielding material 114 for radiation.

Referring again to FIG. 4, the second container 50 is connected to the second control valve 54 via a second fluid conduit 97. Preferably, but not necessarily, there is a gas vent 64 that is connected to the second container 50 via a needle or spike that pierces the previously described septum 106. A preferred, but nonlimiting, example of the fluid delivery and gas venting mechanism 153 includes a "micro-mini spike" such as that manufactured by International Medical Industries, having a place of business at 2881 West McNab Road, Pompano Beach, Fla. 33069.

The gas vent 64 is connected to fluid relationship to a bubble detector 62. The bubble detector 62 is connected in fluid relationship to the second control valve 54. The bubble detector 62 functions to determine if all bubbles in the fluid for the second container 50 have been dissipated via the gas vent 64. A wide variety of bubble detectors will suffice for this application. Illustrative, but nonlimiting, example of a bubble detector 62 includes those manufactured by Introtek International, having a place of business at 150 Executive Drive, Edgewood, N.Y. 11717-9998.

There is an outlet 100 to the manifold 69 that is connected in fluid relationship to the third control valve 56. There is a fluid delivery and gas venting mechanism that is generally indicated by numeral 60 in FIGS. 3 and 4. There is a first connector 119 that attaches to the outlet 100. Connected to the first fluid connector 119 and in fluid relationship therewith is a third fluid conduit 90. The third fluid conduit 90 is attached to a fluid delivery and gas venting mechanism 60. The fluid delivery and gas venting mechanism 60 includes a needle or spike fluid delivery inlet 124.

There is a recipient container receiving liquid that is generally indicated by numeral 58 that is similar to the second container 50 for holding fluid. Preferably, but not necessarily, the recipient container 58 is held in place by a second c-shaped holder 140 and the presence of the recipient container 58 is sensed by a second proximity sensor 155, as shown in FIGS. 3 and 4. A wide variety of containers will suffice for the recipient container 58 with the preferred embodiment being an eluate vial 104, as shown in FIG. 5. The vial 104 includes a cap 102 and a septum 106. The septum 106 is preferably made of an elastomeric material, e.g., rubber. The recipient container 58 is preferably enclosed by a radio-pharmaceutical pig 108 that includes a top portion 112 and a bottom portion 110. The top portion 112 preferably, but not necessarily, includes a first shielding material 116 for radiation and the bottom portion 110 preferably, but not necessarily, includes a second shielding material 114 for radiation.

As shown in FIG. 4, the needle or spike delivery inlet 124 can pierce the septum 106 located in the cap 102 for the recipient container 58. Also, as shown in FIGS. 3, 4 and 5, piercing the septum 106 is a needle or spike fluid venting outlet 124 that directs gas through an internal gas conduit 126 to release gas through a gas outlet 132 that can be directed out of the workstation. A preferred, but nonlimiting, example of the fluid delivery and gas venting mechanism 60 includes a "micro-mini spike" such as that manufactured by International Medical Industries, having a place of business at 2881 West McNab Road, Pompano Beach, Fla. 33069.

There is a first actuating mechanism 37, as shown in FIG. 2, that is connected to the fluid delivery and gas venting mechanism 60 through a first actuating member 31, as shown in FIG. 2, to lift the fluid delivery and gas venting mechanism 60 up and down so that the recipient container 58 can be removed and replaced so that the needle or spike delivery inlet 124 can pierce the septum 106 located in the cap 102 for a new recipient container 58.

The first actuating mechanism 37 includes a lead screw connected to a sixth motor 32, which is preferably a stepper motor, however, any motor that controls and monitors the position of the rotor and can move the rotor of the motor in controlled increments will suffice such as a servo-controlled motor or actuator controlled motor. The sixth motor 32 is attached to the first actuating mechanism 37. Optimally, there are limits, encoders and other mechanisms, to govern the limit of travel for the first actuating mechanism 37 and provide a fixed rotational starting point for the sixth motor 32. A nonlimiting, but illustrative, example of a sixth controlled motor 32 includes HT17-075-2001 manufactured by Applied Motion Products, Inc. having a place of business at 404 Westridge Drive, Watsonville, Calif. 95076. As shown in FIGS. 2, 3 and 4, the first actuating mechanism 37 is connected to the first actuating member 31.

By utilizing the manifold 69, as shown in FIG. 4, the first control valve 52 is connected in fluid relationship to the inlet 73, the first container 48, the fourth container 44 and the third control valve 56. The second control valve 54 is connected in fluid relationship to the bubble detector 62, the second container 50, the third container 46 and the third control valve 56. The third control valve 56 is connected in fluid relationship to the first control valve 52, the second control valve 54 and the outlet 100 for the manifold 69.

An illustrative, but nonlimiting, example of the manifold 69, including the first control valve 52, second control valve 54 and third control valve 56 each includes a DISCOFIX® three (3) way triple stopcock assembly such at that manufactured by B. Braun Melsungen Aktiengesellschaft having a place of business at Carl-Braun-Strasse, 1 Melsungen, Federal Republic of Germany. However, a wide variety of valves will suffice for a control valve 52, 54 and 56, including, but not limited to, needle valves, diaphragm valves, plug valves, glove valves, butterfly valves, and check valves.

Referring now to FIG. 4, the first control valve 52 is operatively connected to a first drive mechanism 78, the third control valve 56 is operatively connected to a third drive mechanism 80, and the second control valve 54 is operatively connected to a second drive mechanism 76. The first drive mechanism 78, second drive mechanism 76 and third drive mechanism 80 are each preferably a rotational right angle gear converter.

The first drive mechanism 78, the second drive mechanism 76 and the third drive mechanism 80 are each attached to a first motor 77, a second motor 75 and a third motor 79, respectively. The first motor 77, the second motor 75 and the third motor 79 are each preferably a stepper motor that rotates in fixed increments, however, any motor that controls and monitors the position of the rotor will suffice such as a servo-controlled motor or actuator controlled motor. Also, pneumatic and vacuum systems can be utilized as drive mechanisms.

Illustrative, but nonlimiting, examples of stepper-controlled motors that can be utilized for the first motor 77, the second motor 75, and the third motor 79 include HT17-075 manufactured by Applied Motion Products, Inc., having a place of business at 404 Westridge Drive, Watsonville, Calif. 95076. Optimally, there are limits, encoders and other mechanisms, to provide a fixed rotational starting point for the first motor 77, the second motor 75, and the third motor 79.

The method of using the previously described automated dispensing system 10 is now described. This automated dispensing system 10 is particularly advantageous for most of the current nuclear medicine diagnostic procedures that use the radioisotope technetium (Tc-99m). The radioactive technetium, obtained from a generator located in a radiopharmacy, is dissolved in a nonradioactive liquid, e.g., saline solution, and is placed in a vial 104 that is surrounded by a lead shield or pig 108. The activity level of this technetium is high (approximately 100 to 1,000 mCi/mL) and must is typically diluted before it is used.

The purpose of the automated bulk dispensing system is to prepare either (1) ready-to-use kits that include (a) radioactive liquid, e.g., technetium, (b) nonradioactive liquid, e.g., saline solution, and (c) lyophilized reagents or (2) multi-dose vials of radioactive liquid, e.g., technetium, and nonradioactive liquid, e.g., saline solution. The multi-dose vials of radioactive liquid, e.g., technetium, are also sold to hospitals and other medical facilities. The hospital or medical facility uses the technetium from the multi-dose vial to prepare their own kits. The multi-dose vials 104 have an activity level that varies from 10–200 mCi/mL. The ready-to-use kits include lyophilized reagents, which do not contain radioactive material, are the product of a "cold" production line. The lyophilized reagents 136, as shown in FIG. 5, have been formulated to collect at specific locations in the body such as the heart, bones or kidneys. The kits are prepared by mixing radioactive liquid, e.g., technetium, and nonradioactive liquid, e.g., saline solution, with the lyophilized reagents at the radiopharmacy. Most of these "prepared" kits contain several individual doses and have an activity level that varies widely depending on the type of radiopharmaceutical prescribed. The activity level in a "prepared kit" may range from 10 to 200 mCi/mL.

The following description is the operational sequence for preparing and filling a kit. All of the functions of the automated bulk dispensing system 10 are controlled by the processor 16. The operator is able to input data from the electronic display 14 that has a touch screen capability or from the keyboard 12 and/or mouse 13, as shown in FIG. 1. In summary, the radioactive liquid, e.g., technetium, is actually diluted twice. The elution is pulled from the second container 50 into the third container 46, then the nonradioactive liquid, saline solution, from the first container 48 is drawn into the third container 46. This dilutes the radioactive liquid, e.g., technetium, down to a "working concentration". During the dispensing cycles (kits or bulk), the nonradioactive liquid, saline solution, is pulled from the first container 48 into the fourth container 44. Then, the radioactive fluid is pushed from the third container 46 into the recipient container 58 and the nonradioactive liquid, saline solution, from the fourth container 44 into the recipient container 58. This action performs a second dilution down to the desired concentration into the recipient container 58. Dispensing of multiple vials can continue until the third container 46 is empty. Thereafter, the third container 46 can be refilled (and re-diluted to the "working concentration") at any time.

Referring now to FIG. 4, preferably the second container 50 is utilized for a radioactive fluid and the first container 48 is utilized for a nonradioactive fluid. An illustrative, but nonlimiting, example of the nonradioactive fluid is a saline solution and an illustrative, but nonlimiting example of the radioactive fluid is technetium. Prior to placing the radioactive liquid, e.g., technetium, in the second container 50, the activity level of the radioactive liquid, e.g., technetium, is checked on a source calibrator (not shown) and this information is listed on the eluate vial 104, as shown in FIG. 5, or is otherwise given to the operator. The operator enters the activity and calibration time from the source calibrator in the processor 16, as shown in FIG. 1. The operator then selects a predetermined target concentration for the kit.

Referring again to FIG. 4, both the third container 46 and the fourth container 44 are initially both empty. In the preferred illustrative, but nonlimiting, embodiment the first container 48 is filed with saline solution and the second container 50 that has an eluate vial 104, as shown in FIG. 5, is filed with radioactive liquid, e.g., technetium, are both connected to the manifold 69. The recipient container 58, preferably but not necessarily, contains lyophilized reagents 136 is connected to fluid deliver and gas venting device 60, e.g., the micro-mini spike, which is connected to an outlet 100 of the manifold 69.

The goal is to transfer radioactive liquid, e.g., technetium, from the eluate vial 104 and nonradioactive liquid, e.g., saline solution, from the first container 48 into the recipient container 58 to prepare the kit. The shelf life of an empty kit with lyophilized reagents 136 is relatively long. However, once the radioactive liquid, e.g., technetium, and nonradioactive liquid, e.g., saline solution, are added to the kit, the shelf life of the kit is considerably diminished. Therefore, kits are typically only prepared on an as-needed basis. The radioactivity of the fluid in the recipient container 58 and the second container is calculated by the processor 16 and is a timing function.

After all of the independent variables have been entered into the processor 16, the automated bulk dispensing system 10 is actuated and the filling process proceeds automatically. The manifold 69, the third container 46, e.g., 35 mL syringe, and the fourth container 44, e.g., 10 mL syringe, are blocked from the operator's view behind the cover enclosure 5.

The following description provides the operational sequence involved with the filling of a kit. The first step is that the third control valve 56 is closed by operation of the third drive mechanism 80 and the second control valve 54 is opened by operation of the second drive mechanism 76. The first displacement mechanism, e.g., actuator, 35 is activated to draw the radioactive liquid, e.g., technetium, from the eluate vial 104 for the second container 50 into the third container 46, e.g., 35 mL syringe. The radioactive liquid, e.g., technetium, from several eluate vials 104 may be transferred to the third container 46, e.g., 35 mL syringe. This depends on the type and number of kits that are being prepared.

The second step is that the first control valve 52 and the third control valve 56 are then opened and the nonradioactive liquid, e.g., saline solution, flows from the first container 48 and is pulled into the third container 46, e.g., 35 mL syringe. Then the third container 46, e.g., 35 mL syringe, is activated and the first plunger 94 draws the required amount of liquid, e.g., saline solution, into the third container 46, e.g., 35 mL syringe.

The third step is that the third control valve 56 is then closed via the third drive mechanism 80. The third container 46, e.g., 35 mL syringe, is then stroked several times via the first displacement mechanism, e.g., actuator, 35 to mix the radioactive liquid, e.g., technetium, with the nonradioactive liquid, e.g., saline solution. The gas vent 64 allows gas to move in and out of the third container 46, e.g., 35 mL syringe, while the first plunger 94 is being stroked by the first mechanism, e.g., actuator, 35.

In the fourth step, the third control valve 56 is then opened and the third container 46, e.g., 35 mL syringe, is discharged allowing the mixture of radioactive liquid, e.g., technetium, and nonradioactive liquid, e.g., saline solution, to flow through the manifold outlet 100 through the fluid delivery and gas venting device 60, e.g., micro-mini spike, and into the recipient container 58.

Depending on the preparation parameters for a multi-dose container, e.g., desired final concentration of dispense radioactive solution, the first control valve 52 may be opened so that additional nonradioactive liquid, e.g., saline solution, from the first container 48 may be added to the final recipient container 58. If required, the first control valve 52 is opened by operation of the first drive mechanism 78 so that the nonradioactive fluid, e.g., saline solution, flows from the first container 48 to the third container 46, e.g., 35 ml syringe. If no additional saline solution is ever needed, the first control valve 52 is not opened and the third drive mechanism 80 is not activated.

After the recipient container 58, e.g., vial, is filled to a predetermined level, the fluid delivery and gas venting mechanism 60, e.g., micro-mini spike, is removed from the recipient container 58 by the first actuating mechanism 162 and replaced with a new recipient container 58. Several of the recipient containers 58, e.g., vials, containing lyophilized reagents 136 may be sequentially filled depending on the situation.

Completed kits are assayed for activity in a source calibrator (not shown) and are labeled for shipment to the hospital or used by the radio-pharmacy for dispensing the radiopharmaceutical into unit dosages, i.e., syringes. The completed kits are kept in lead containers or pigs 108 so that the completed kits can be safely handled. The fluid delivery and gas venting mechanism 60, e.g., micro-mini spike, is preferably changed after each drug type, e.g., vial, containing the lyophilized reagent 136 or may be flushed with saline solution from first container 48 after the preparation of a similar drug type kits are completed to prevent cross-contamination.

The following description provides the operational sequence involved with the filling of a multi-dose container of radioactive liquid, e.g., technetium. Again, after all of the independent variables have been entered into the processor 16, the automated bulk dispensing system 10 is actuated and the filling process proceeds automatically.

The first step is that the third control valve 56 is closed by operation of the third drive mechanism 80 and the second control valve 54 is opened by operation of the second drive mechanism 76. The first displacement mechanism, e.g., actuator, 35 is actuated to draw the radioactive liquid, e.g., technetium, from the eluate vial 104 of the second container 50 into the third container 46, e.g., 35 mL syringe. The radioactive liquid, e.g., technetium, from several eluate vials 104 may be transferred to a third container 46, e.g., 35 mL syringe.

The second step is that the first control valve 52 is opened by operation of the first drive mechanism 78 and the third control valve 56 is opened by operation of the third drive mechanism 80 so that the nonradioactive liquid, e.g., saline solution, flows or is pulled from the first container 48 to the third container 46, e.g., 35 mL syringe.

The third step is that the third control valve 56 is then closed via the third drive mechanism 80. The fourth step is that the third container 46, e.g., 35 mL syringe, is then stroked several times via the first mechanism, e.g., actuator, 35 to mix the radioactive liquid, e.g., technetium, with the nonradioactive liquid, e.g., saline solution. The gas vent 64 allows gas to move in and out of the third container 46, e.g., 35 mL syringe, while the first plunger 94 is being stroked by the first mechanism, e.g., actuator, 35.

The fourth step is that is that the third control valve 56 is then opened and the third container 46, e.g., 35 mL syringe, is discharged allowing the mixture of radioactive liquid, e.g., technetium, and nonradioactive liquid, e.g., saline solution, to flow through the outlet 100 for the manifold 69 through the fluid delivery and gas venting device 60, e.g., micro-mini spike, and into the recipient container 58.

Depending upon the preparation parameters for a multi-dose container, e.g., desired final concentration of disperse radioactive liquid, the first control valve 52 may be opened so that additional saline solution from the first container 48 may be added to the final recipient container 58. If required, the first control valve 52 is opened by operation of the first drive mechanism 78 so that the nonradioactive liquid, e.g., saline solution, flows from the first container 48 to the third container 46, e.g., 35 mL syringe. If no additional saline solution is ever needed, the first control valve 52 is not opened and the third drive mechanism 80 is not activated.

The fifth step is that the fluid delivery and gas venting device 60, e.g., micro-mini spike is removed from the recipient container 58 by the first actuating mechanism 162 after the total volume of radioactive liquid, e.g., technetium, from the third container 46 and the nonradioactive liquid, e.g., saline solution, from the second container 44 is delivered to the recipient container 58.

After the recipient container 58, e.g., multi-dose vial, is filled to a predetermined level, the fluid delivery and gas venting device 60, e.g., micro-mini spike, is removed with the first actuating mechanism 162 and replaced with a new recipient container 58. Several of the recipient containers 58, e.g., vials, may be sequentially filled depending on the situation.

Completed multi-dose vials, containing radioactive liquid, e.g., technetium, are assayed for activity in a source calibrator (not shown) and labeled before dispensing individual unit dosages into syringes or before the multi-dose vial is shipped to a medical facility for use. All multi-dose vials are kept in lead containers or pigs 108 so that the radioactive material can be safely handled. The fluid delivery and gas venting device 60, e.g., micro-mini spike, is preferably changed afterward each drug type or flushed afterwards to prevent cross-contamination.

Although the preferred embodiment of the present invention and the method of using the same has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

The invention claimed is:

1. An automated bulk dispensing system for dispensing a radioactive material, comprising:

a first container;

a second container;

a third container;

a first displacement mechanism that is operatively connected to the third container;

a recipient container;

at least one control valve connected to the first, second, and third containers;

at least one drive mechanism operatively connected to the at least one control valve to selectively control liquid flow from the first container into the third container, from the second container into the third container, and from the third container into the recipient container;

a radiation shield disposed at least about the third container, wherein the second container, or the recipient container, or both the second container and the recipient container comprises independent radiation shielding at least partially outside of the radiation shield; and a processor operatively connected to the at least one drive mechanism and the first displacement mechanism.

2. The automated bulk dispensing system of claim 1, wherein the at least one control valve includes at least one four-way stopcock.

3. The automated bulk dispensing system of claim 1, wherein the at least one drive mechanism includes at least one first motor that can rotate in controlled increments.

4. The automated bulk dispensing system of claim 1, wherein the first displacement mechanism includes a second motor that can rotate in controlled increments and is operatively connected to an actuator.

5. The automated bulk dispensing system of claim 4, wherein the third container includes a syringe, having a longitudinal axis, and the actuator of the first displacement mechanism includes a member that is operatively connected to a plunger, wherein the plunger is located within the syringe, wherein rotation of the second motor provides movement of the member to displace the plunger along the longitudinal axis of the syringe.

6. The automated bulk dispensing system of claim 5, wherein the member includes a lead screw and the second motor includes a stepper motor.

7. The automated bulk dispensing system of claim 1, further comprising a gas vent that is connected between the at least one control valve and the second container.

8. The automated bulk dispensing system of claim 1, further comprising a bubble detector that is connected between the at least one first control valve and the second container, wherein the bubble detector is electrically connected to the processor.

9. The automated bulk dispensing system of claim 1, further comprising a gas vent and a bubble detector that are both connected between the at least one control valve and the second container, wherein the bubble detector is electrically connected to the processor.

10. The automated bulk dispensing system of claim 1, wherein the second container includes a vial that is at least partially surrounded by the independent radiation shielding.

11. The automated bulk dispensing system of claim 1, further comprising a fluid delivery and gas-venting mechanism operatively connected to the recipient container.

12. The automated bulk dispensing system of claim 1, further comprising a fluid delivery and gas-venting mechanism that can be operatively connected to the recipient container and removed from the recipient container by activation of a first actuating mechanism.

13. The automated bulk dispensing system of claim 11, wherein the fluid delivery and gas venting mechanism includes a micro-mini spike and the recipient container includes a vial.

14. The automated bulk dispensing system of claim 1, wherein the first container includes a nonradioactive liquid, the second container includes a radioactive liquid, and the recipient container includes a reagent.

15. The automated bulk dispensing system of claim 1, further comprising:

the at least one control valve including a first control valve connected to the first container and a fourth container, a second control valve connected to the second container and the third container, and a third control valve connected to the first control valve, the second control valve, the third container, and the recipient container;

a second displacement mechanism that is operatively connected to the fourth container;

the at least one drive mechanism including a first drive mechanism operatively connected to the first control valve, a second drive mechanism operatively connected to the second control valve, and a third drive mechanism operatively connected to the third control valve; and the processor operatively connected to the second displacement mechanism, the first drive mechanism, the second drive mechanism, and the third drive mechanism.

16. The automated bulk dispensing system of claim 15, wherein the first control valve includes a first stopcock, the second control valve includes a second stopcock, the third control valve includes a third stopcock.

17. The automated bulk dispensing system of claim 15, wherein the first drive mechanism includes a first motor, the second drive mechanism includes a second motor, and the third drive mechanism includes a third motor.

18. The automated bulk dispensing system of claim 15, wherein the first displacement mechanism includes a first motor operatively connected to a first plunger in the third container, and the second displacement mechanism includes a second motor operatively connected to a second plunger in the fourth container.

19. A method for filling containers utilizing an automated bulk dispensing system, comprising:

selectively receiving a first amount of radioactive liquid from a second container into a third container through at least one first control valve;

selectively receiving a second amount of nonradioactive liquid from a first container into the third container through the at least one control valve;

mixing the radioactive liquid and the nonradioactive liquid in the third container with a first displacement mechanism operatively connected to the third container for displacing liquid within the third container, wherein the first displacement mechanism is selectively controlled by a processor;

dispensing the mixture of the radioactive liquid and the nonradioactive liquid from the third container with the first displacement mechanism through the at least one first control valve and into a recipient container, wherein the at least one first control valve is connected to first, second, and third containers, and wherein the at least one first control valve is connected to at least one first drive mechanism to selectively control the flow of liquid into and out of the third container, wherein the first drive mechanism is controlled by the processor;

shielding radiation from the radioactive liquid disposed in the third container, the at least one first control valve, and at least one fluid conduit coupled to the third container; and independently shielding radiation from the mixture dispensed into the recipient container or radiation from the radioactive liquid disposed in the second container.

20. The method of claim 19, further comprising releasing gas through a vent and determining if any bubbles are present in the mixture of the radioactive liquid and the nonradioactive liquid with a bubble detector prior to dispensing the mixture of the radioactive liquid and the nonradioactive liquid from the third container through the at least one first control valve into the recipient container.

21. The method of claim 19, wherein the radioactive liquid includes technetium and the nonradioactive liquid includes a saline solution.

22. The method of claim 19, wherein dispensing comprises outputting the mixture into the recipient container to mix with a reagent disposed in the recipient container.

23. A method for filling containers utilizing an automated bulk dispensing system comprising:

selectively receiving a predetermined amount of radioactive liquid from a second container into a third container through a second control valve;

selectively receiving a predetermined amount of nonradioactive liquid from a first container into a fourth container through a first control valve;

selectively transferring a predetermined amount of nonradioactive liquid from the fourth container into the third container through a third control valve and the second control valve with a first displacement mechanism, which is operatively connected to the fourth container for displacing liquid from the fourth container and the first displacement mechanism is selectively controlled by a processor and is operatively connected thereto;

mixing the radioactive liquid and the nonradioactive liquid in the third container with a second displacement mechanism, which is operatively connected to the third container for displacing liquid from the third container, wherein the second displacement mechanism is selectively controlled by a processor and is operatively connected thereto;

dispensing the mixture of the radioactive liquid and the nonradioactive liquid from the third container with the second displacement mechanism through the second control valve and the third control valve into a recipient container, wherein the first container and the fourth container are connected in fluid relationship to the first control valve, the second container and the third container are connected in fluid relationship to the second control valve, the first control valve and the second control valve are connected in fluid relationship to the third control valve and the recipient container is connected in fluid relationship to the third control valve, wherein there is a first drive mechanism that is operatively attached to the first control valve, a second drive mechanism that is operatively attached to the second control valve and a third second drive mechanism that is operatively attached to the third control valve, wherein the first drive mechanism, the second drive mechanism, and the third drive mechanism are all selectively controlled by the processor and are operatively connected thereto; and a reagent located in the recipient container that can react with the mixture of the radioactive liquid and the nonradioactive liquid.

24. The method of claim 23, wherein the reagent includes a lyophilized reagent.

25. The method of claim 23, further comprising releasing gas through a vent and determining if any bubbles are present in the mixture of the radioactive liquid and the nonradioactive liquid with a bubble detector prior to dispensing the mixture of the radioactive liquid and the nonradioactive liquid from the third container through the second control valve and the third control valve into the recipient container.

26. The method of claim 23, wherein the mixing the radioactive liquid and the nonradioactive liquid in the third container and dispensing the mixture of the radioactive liquid and the nonradioactive liquid from the third container to the recipient container with the first displacement mechanism that includes a first motor that can rotate in controlled increments and is operatively connected to a first actuator and wherein the selectively transferring a predetermined amount of nonradioactive liquid from the fourth container into the third container with the second displacement mechanism that includes a second motor that can rotate in controlled increments and is operatively connected to a second actuator.

27. The method of claim 26, wherein the first actuator includes a first lead screw and a first plunger and the first motor includes a first stepper motor and the third container includes a first syringe, wherein the first plunger is located within the first syringe and wherein the second actuator includes a second lead screw and a second plunger and the second motor includes a second stepper motor and the fourth container includes a second syringe, wherein the second plunger is located within the second syringe.

28. The method of claim 23, wherein the radioactive liquid includes technetium and the nonradioactive liquid includes a saline solution.

* * * * *